US006009974A

United States Patent [19]

Jones

[11] Patent Number: 6,009,974

[45] Date of Patent: Jan. 4, 2000

[54] LADDER BRACKET

[76] Inventor: Robert Eric Jones, Box 461 R.D. #2, Mansfield, Pa. 16933

[21] Appl. No.: 09/256,253

[22] Filed: Feb. 23, 1999

Related U.S. Application Data

[60] Provisional application No. 60/075,866, Feb. 25, 1998.

[51] Int. Cl.[7] ..... E06C 7/48

[52] U.S. Cl. ..... 182/107; 182/214

[58] Field of Search ..... 182/107, 214, 182/108, 111

[56] References Cited

U.S. PATENT DOCUMENTS

| | | | |
|---|---|---|---|
| 195,484 | 9/1877 | Collis | 182/214 |
| 1,541,402 | 6/1925 | Seaman | 182/214 |
| 2,448,350 | 8/1948 | Brown . | |
| 2,722,360 | 11/1955 | Malm . | |
| 2,815,160 | 12/1957 | Gilmour et al. . | |
| 3,318,416 | 5/1967 | Robinson . | |
| 4,678,061 | 7/1987 | Jordan | 182/206 |
| 4,754,842 | 7/1988 | Southern | 182/214 |
| 5,180,032 | 1/1993 | Hidalgo . | |

FOREIGN PATENT DOCUMENTS

| | | | |
|---|---|---|---|
| 2699221 | 6/1994 | France | 182/214 |
| 908066 | 10/1962 | United Kingdom | 182/108 |

*Primary Examiner*—Alvin Chin-Shue
*Attorney, Agent, or Firm*—Frank LaViola, Jr.

[57] ABSTRACT

A ladder bracket for attachment to the side rails of a ladder to allow the ladder to be used against the side of a building or structure without causing damage to the gutters, eave troughs, etc. The ladder bracket distributes the weight of the ladder and user onto the roof surface by a pivoting bearing surface which accommodates all roof pitches. The ladder bracket does not rely upon the structure of the rungs of a ladder for positioning or support. This makes this ladder bracket infinitely adjustable along the length of the side rail. The sleeve of the bracket is slightly larger in dimension than the width of the side rail and thus, when load is placed upon the ladder, the bracket pivots slighltly outward relative to the building or structure. This pivoting action causes the bracket to lock against the side rail and prevents slippage.

3 Claims, 4 Drawing Sheets

LADDER BRACKET

RELATED APPLICATIONS

This application relates to previously filed provisional application 60/075,866 filed Feb. 25, 1998 by the same inventor and is drawn to the same invention filed herewith.

BACKGROUND OF THE INVENTION

1. Field of the Invention

This field of this invention relates to ladders. More specifically, the present invention is drawn to a ladder bracket which is removably attached to the side rails of a ladder and is designed to space the ladder away from a structure to prevent damage to any protruding items such as gutters, eave troughs, etc. Another feature of this invention is its unique design which allows for virtually infinite positioning along the length of the ladder side rail. The position of the ladder bracket is independent of location of the rungs and does not in any way rely upon the rung for attachment or positioning.

2. Description of the Prior Art

Many various types of these brackets have been developed over the years to solve the problem of damage to gutters, etc. caused by leaning a ladder against them in use. Some attempts to alleviate this problem use the side of the structure to bear the force. These are commonly called "stand-offs". Other attempts were made to solve this problem by using a reinforcement device positioned within the gutter to bear the brunt of the force. All the attempts listed have disadvantages that the present invention addresses and solves.

One of the main disadvantages of the prior art is the complexity of design and thus difficulty of use. Another disadvantage is the heavy reliance on rungs for both support and positioning of the device. This causes problems in that the position of the device along the side rail is limited by the location of the rungs. Another disadvantage of the prior art is that the devices which do not use the rungs of the ladder for support and positioning have very complicated and cumbersome locking mechanism. In addition, many are of one piece design which may cause tripping hazards if access to the roof is required. The following patents show the general state of the art in this field.

U.S. Pat. No. 2,448,350 shows a single piece, rung supported device having a pivoted plate which engages the roof surface. This design is both inflexible to positioning and also poses a trip hazard with regard to the plate if roof access is required. Also notice the complicated locking mechanism. U.S. Pat. No. 2,815,160 shows a two piece ladder attachment which again is heavily reliant upon the rung for both positioning and support. Also the handle is inside the ladder rung area which poses a very serious trip hazard issue. U.S. Pat. No. 5,180,032 shows both a device for insertion into a gutter and also a ladder attachment which has side rails permanently attached to the ladder side rails. This requires permanent modification of the existing ladder structure for use.

As can be seen from the prior art a need exists for a ladder bracket which is both safe and easy to use. A more important need is for a ladder bracket which provides maximum adjustment and an unlimited range of positions along the side rail. This bracket is designed to fit virtually all makes and models of extension ladders. The present invention has all of these attributes along with an uncomplicated locking action which uses the natural weight and forces exerted in use to prevent movement of the ladder brackets along the side rails of the ladder.

SUMMARY OF THE INVENTION

In view of the known prior art in the field of ladder brackets and ladder attachment apparatus there are many disadvantages in design, use and complexity. The present invention addresses the need for an improved ladder bracket which has all of the advantages of the prior art ladder brackets and none of the disadvantages.

The ladder bracket of the present invention provides a ladder bracket which, when attached to the side rail of a ladder, distributes the weight of the ladder and user to the roof of the structure it is being used on. Another main function of the ladder bracket is to help prevent damage to the gutters, eave troughs and other features of a structure which are normally damaged by leaning a ladder against them in use. These gutters and like items are not designed to bear the weight of a ladder and user and thus, expensive damage can occur. A further advantage of the present invention lies in the simple yet effective way in which the bracket locks itself onto the side rail of the ladder. The locking mechanism is one of a "binding" action whereby, in a loaded condition, the ladder bracket pivots slightly outward creating this "binding" action. The direction of pivot is away from the structure at the top of the bracket and toward the structure at the bottom of the bracket. This locking feature is allowed to occur since the inside dimension of the bracket is slightly larger than the dimension of the side rail of the ladder. Another advantage of the present invention is that the force of the weight of the ladder and user is kept perpendicular to the surface of the roof. The is accomplished by allowing the curved band of material to be formed into a curvature that both accommodates the bridging of the gutters and also allows the band to flex slightly in a loaded condition which keeps the forces acting perpendicular to the roof surface. Another main advantage of the present invention is that this particular ladder bracket is almost infinitely positionable along the length of the side rail. The prior art relies heavily on the rungs of a ladder as a means of support and positioning. The present invention overcomes this limitation by the locking mechanism discussed earlier and by providing a gap along the inner wall of the sleeve so as to not interfere with the rungs during positioning.

It has thus been outlined, rather broadly, the most important features of the invention so that the following detailed description can be more easily understood. The invention, it is believed, may not lie in just one of the features but in a combination of some or all of these features.

DETAILED DESCRIPTION OF THE INVENTION

Figure 1:
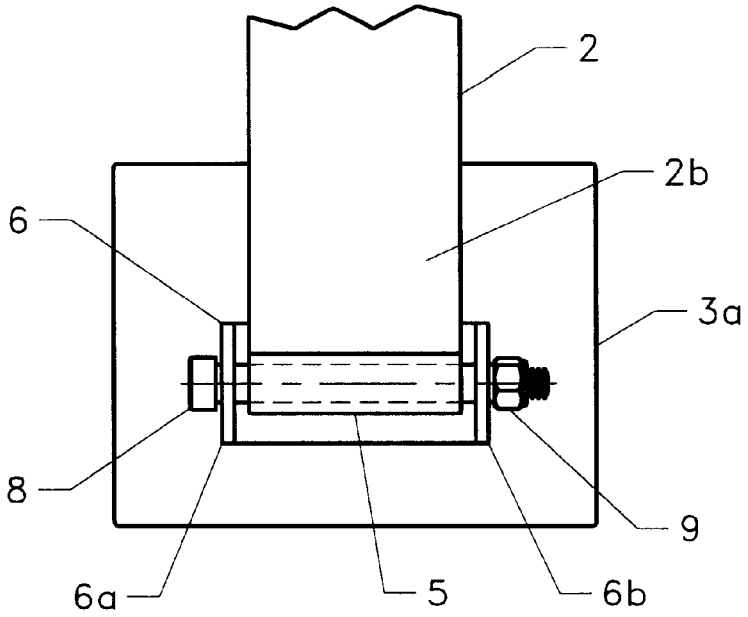
FIG. 1 is a view of the bearing pad assembly and shows the pivoting structure of the present invention.
Figure 4:
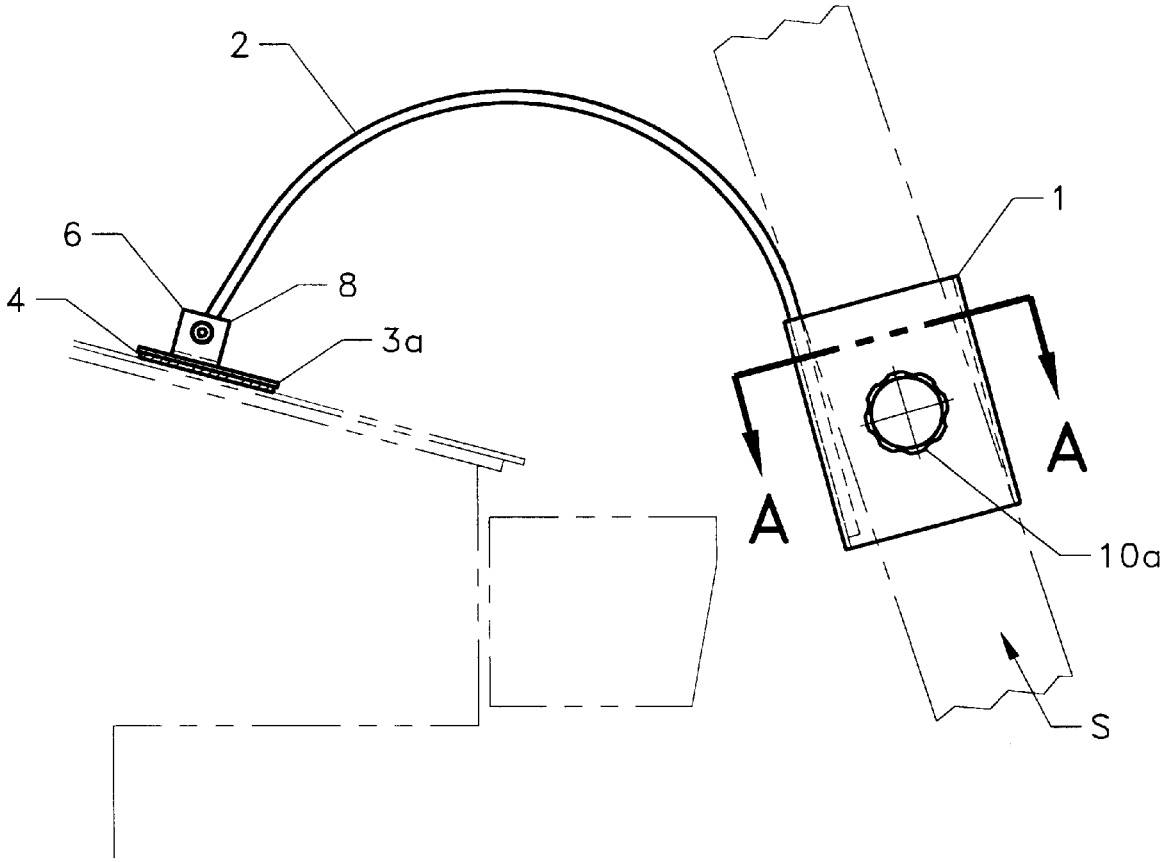
FIG. 4 is a side view of a ladder having the ladder bracket of the instant invention attached to the side rail of the ladder in a typical fashion and showing its intended use.
Figure 5:
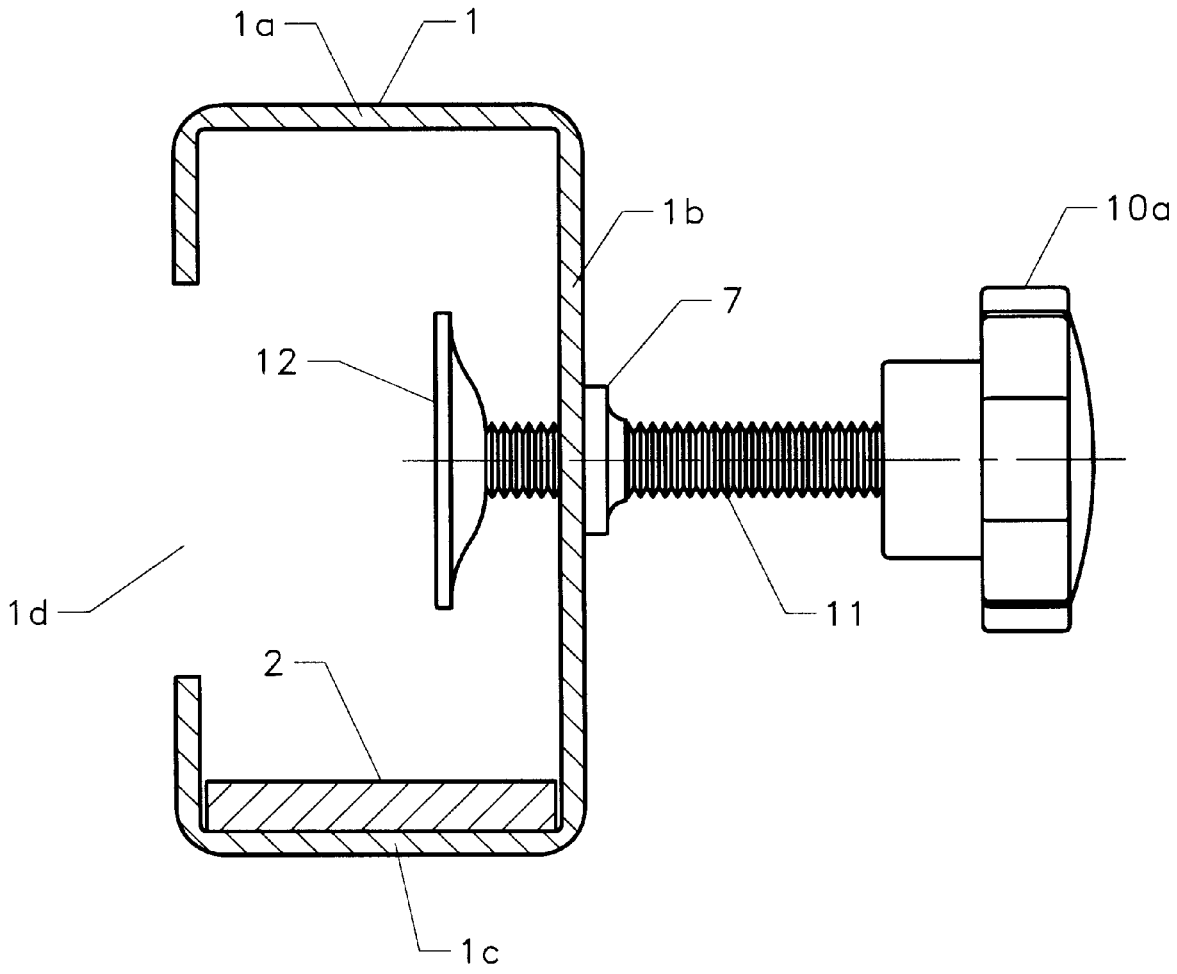
FIG. 5 is a cross-sectional view of the construction of the ladder bracket along line A—A of FIG. 4.

With reference now to the drawings, and in particular FIG. 4–5, the ladder bracket 100 of the instant invention comprises a rectangular sleeve 1 having three continuous sides 1*a*, 1*b*, 1*c* and a gap 1*d* alone the entire length of the fourth side. This gap 1*d* allows for the rungs of a ladder to not interfere with the positioning along the side rail S of a ladder L. The rectangular sleeve 1 has a dimension D, as seen in FIG. 5, which is of a slightly larger dimensioning than that of the side rail S. The importance of this slight difference in dimension still become more apparent later. A thin, arched band member 2 has a proximal end 2*a* and a distal end 2*b* and is attached at its proximal end 2*a* to the sleeve 1 along its entire length. The arched band member 2 extends outwardly and away from the sleeve 1 in a pre-determined curvature C and has pivotally attached to its distal end 2*b* a bearing pad assembly 3. The bearing pad assembly 3 comprises a flat plate 3*a* with a piece of resilient material 4 attached thereto. The resilient material 4 can be made from rubber, foam or any other suitable material which has a relatively high co-efficient of friction so as to not slip when in contact with various roof surfaces. The pivoting action of the bearing pad assembly 3 is best seen in FIG. 1. A U-shaped clip 6 is attached to the flat plate 3*a* with the U-shaped clip 6 having a pair of legs 6*a*, 6*b* with at hole 6*c* therethrough allowing the bearing pad assembly 3 to pivot about this point. Positioned between the legs 6*a*, 6*b* is a piece of hollow tubing 5. Through this tubing 5 extends a shoulder bolt 8 and affixed to the threaded end of the shoulder bolt 8 is a lock nut 9. The tubing 5 is fixedly attached to the distal end 2*b* of the arched band member 2.

A handle 10 having a gripping portion 10*a* and a threaded portion 11 is received through the outer continuous wall 1*b* of the rectangular sleeve 1. This threaded portion 11 is screwed into a like threaded socket 7 and at its terminal end, inside the internal cavity 1*e* of the rectangular sleeve 1, is attached a captive washer 12. This handle 10 is tightened when the ladder bracket 100 is placed on the side rail S of the ladder L to make the bracket fit snugly to the side rail in that direction. The gripping portion 10*a* can be made of any suitable material such as plastics and metal, with plastics being preferred due to its lightweight and cost effectiveness.

As seen in FIG. 1., the U-shaped clip 6 is attached to flat plate 3*a* at a point spaced from its midpoint causing an uneven distribution of weight about its pivot point. This imbalance will keep the angle of the bearing pad assembly 3 relatively parallel to th surface of the roof during initial positioning of the ladder and bracket combination in a ready to use position.

The materials used in the construction of this ladder bracket 100 can be metal, high strength plastics and any other suitable materials which have sufficient strength and durability.

While the above paragraphs describe a single ladder bracket, the bracket is used as a pair. The same description applies to the other bracket and is used in tandem with the previously described bracket. A pair of brackets would constitute a bracket of right hand construction and a bracket of left hand construction. The brackets are of identical structure and mount to the side rails of a ladder in the same way.

Figure 2:
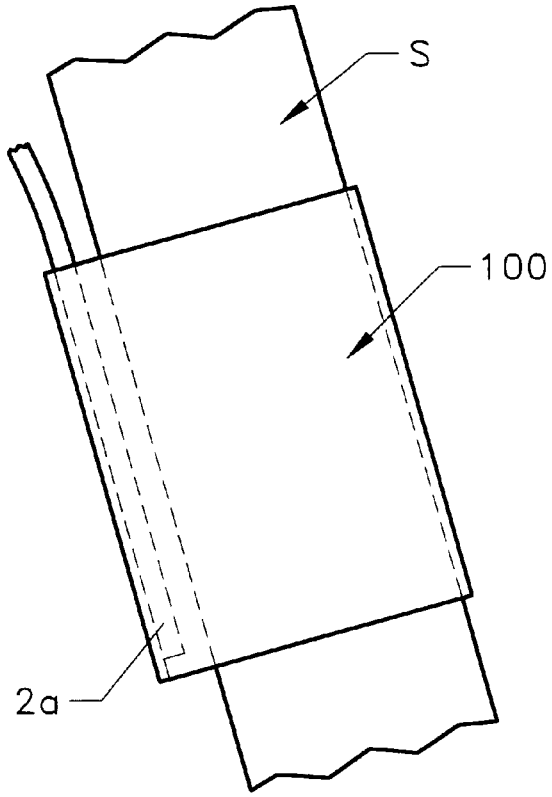
FIG. 2 is a partial side view of a ladder bracket shown attached to a side rail of a ladder in a ready for use, unloaded position. The handle has been omitted in this view for clarity.
Figure 3:
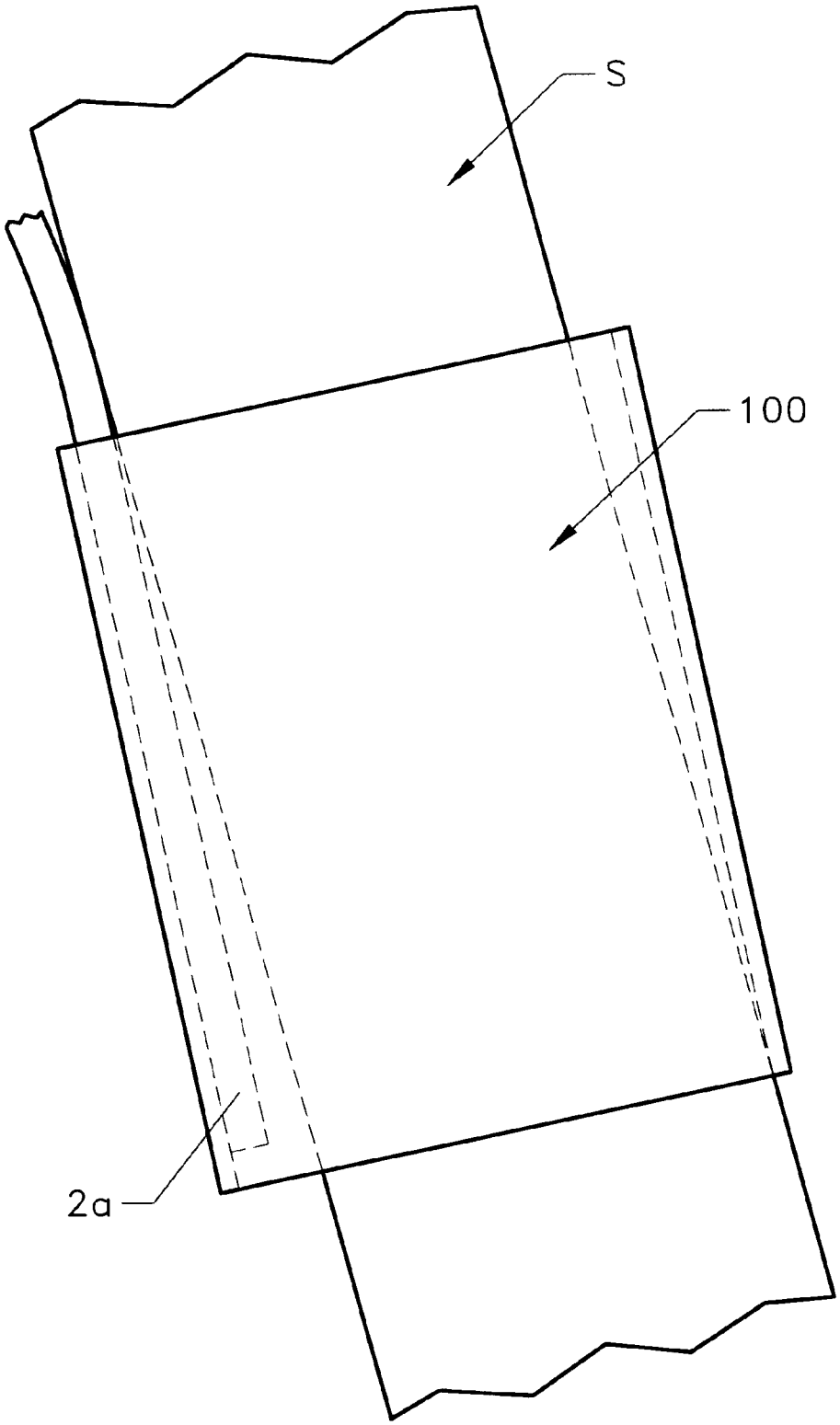
FIG. 3 is a partial side view of a ladder bracket shown attached to a side rail of a ladder in a loaded condition to illustrate the pivoting action which takes place. The handle has also been omitted in this view for clarity.

The use of the ladder bracket will now be discussed in detail with particular attention to FIG. 2–3. The ladder bracket 100 is applied to the side rail S of the ladder L by sliding the bracket 100 onto the exposed end of the ladder. The handle 10 is used to position the bracket 100 along the side rail S without restriction from or dependence on the rungs of the ladder. It should be pointed out that a unique feature of this design is that the handle 10 is used as a positioning device only and is not intended to be a means of support for the bracket in use. This will become more evident as we continue the method of use. The use of the other bracket of the pair is identical to that described herein and thus will not be discussed in great detail. After both brackets 100 are secured and positioned along their respective side rails S, the ladder and ladder brackets are erected into the use position as shown in FIG. 4. The arched band member 2 spans the gutter G and the bearing pad assembly 3 contacts the roof surface. Due to the unbalanced condition of the bearing pad assembly 3, the bottom surface of the bearing pad assembly 3 stays relatively parallel to the roof surface thereby making erection of the ladder easier. FIG. 2 shows an exploded view of the rectangular sleeve 1 relative to the side rail S of the ladder. The view shown in FIG. 2. is that of an unloaded ladder. FIG. 3 shows as similar view as that of FIG. 2 except that this is the condition of the rectangular sleeve 1 in a loaded condition. In the loaded condition of FIG. 3, the rectangular sleeve 1 pivots or rotates away from the structure due to the slightly larger dimension D of the cavity 1*e* than the side rail. This action is the force that keeps the brackets 100 from slipping along the side rail S in use. The size of the space caused by this difference of dimensions is not critical, but it is the use of the forces in effect during loading which are the necessary to create this locking or "binding" action. These forces are present and sufficient to effect positive locking even if the dimension D and side rail S are virtually equal. Also, in the loaded condition, the forces of the ladder and user are directed perpendicular to the roof surface. This is assured through the pre-determined curvature C of the arched band member 2 and also due to the ability of the arched band member 2 to slightly flex. This flexing action keeps the forces perpendicular to the roof surface.

I claim:

1. A ladder bracket for attachment to a side rail of a ladder, said ladder bracket comprising:

a rectangular sleeve, said rectangular sleeve having a length and an internal cavity along said length, said rectangular sleeve being of continuous construction along three sides and having a gap entirely along said length on a fourth side;

a thin, arched band member having a distal end and a proximal end, said arched band member being attached at its proximal end to said rectangular sleeve, said arched band member extending above and away from said rectangular sleeve at a pre-determined curvature;

said thin, arched band member has a thickness and a width, said width being substantially greater than said thickness; said thickness being of a size such that a slight flexing occurs under a loaded condition;

a bearing pad assembly pivotally attached to said distal end of said arched band member, said bearing pad assembly being attached to said arched band member by a clip, said clip being attached to an upper surface of said bearing pad assembly; said bearing pad assembly further comprising:

a flat plate attached to said clip, said clip being U-shaped having two parallel legs, said legs each having a through hole to allow for pivoting of said bearing pad assembly;

said flat plate has a midpoint; said clip being attached to said flat palate at a point spaced from said midpoint in a direction away from said rectangular sleeve so that a larger portion of said flat plate is below said clip;

a resilient material fixedly attached to said flat plate along an underside surface of said flat plate, whereby said slightly larger dimension of said internal cavity allows for a slight outward pivoting action of the ladder bracket in a loaded condition, said pivoting action causing said ladder bracket to lock itself into position to prevent slippage of said ladder bracket.

2. The ladder bracket of claim 1, further comprising;

a handle assembly attached to said rectangular sleeve, said handle assembly having a threaded portion and a gripping portion, said threaded portion having attached thereto a captive washer, said handle assembly providing means for positioning said ladder bracket on a side rail of a ladder.

3. The ladder bracket of claims 1, wherein said ladder bracket is one of a pair of ladder brackets used together, said pair comprising;

a ladder bracket of left hand construction and;

a ladder bracket of right hand construction.

* * * * *